US005853008A

United States Patent [19]

Nelson

[11] Patent Number: 5,853,008

[45] Date of Patent: Dec. 29, 1998

[54] SCALP HAIR FOUNDATION TO PROVIDE ADDITIONAL HAIR

[75] Inventor: Charles W. Nelson, Lee's Summit, Mo.

[73] Assignee: Apollo Products, Inc., Kansas City, Mo.

[21] Appl. No.: 24,202

[22] Filed: Feb. 16, 1998

[51] Int. Cl.[6] ..... A41G 3/00; A41G 5/00

[52] U.S. Cl. ..... 132/53; 132/201; 132/200

[58] Field of Search ..... 132/53, 54, 55, 132/56, 200, 201

[56] References Cited

U.S. PATENT DOCUMENTS 3,970,092 7/1976 Nelson .
4,254,784 3/1981 Nelson .
4,372,330 2/1983 Nelson .
4,739,777 4/1988 Nelson .
4,976,621 12/1990 Wieneke .

*Primary Examiner*—Gene Mancene
*Assistant Examiner*—Pedro Philogene
*Attorney, Agent, or Firm*—Hovey, Williams, Timmons & Collins

[57] ABSTRACT

A method of covering a bald area (20) on a person's head uses a filler piece (10) having a foundation (12) with filler hair (14) attached thereto and conforming substantially to the shape of the bald area (20). The filler piece (10) is attached to the bald area (20) by adhering the foundation (12) thereto. Side hair (24) of sufficient length is then positioned in spanning relationship with the filler piece (10) and commingled with the filler hair (14) to hold the side hair (24) in the spanning relationship.

7 Claims, 1 Drawing Sheet

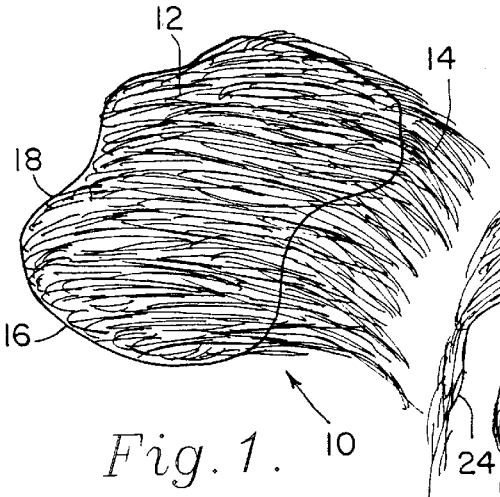
Fig. 1.
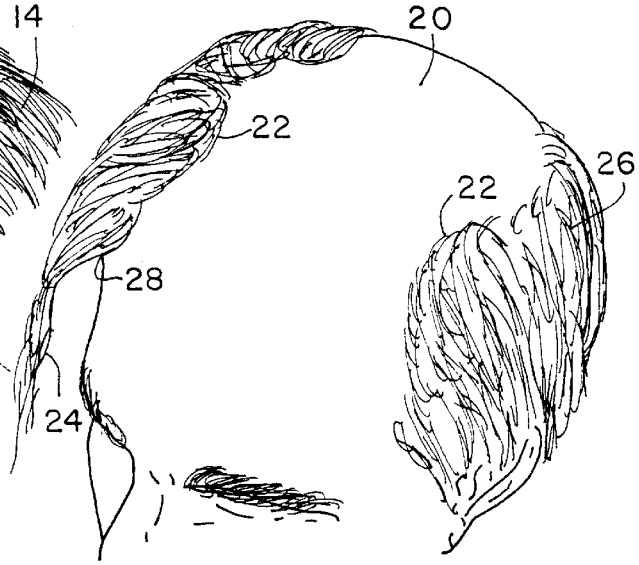
Fig. 2.
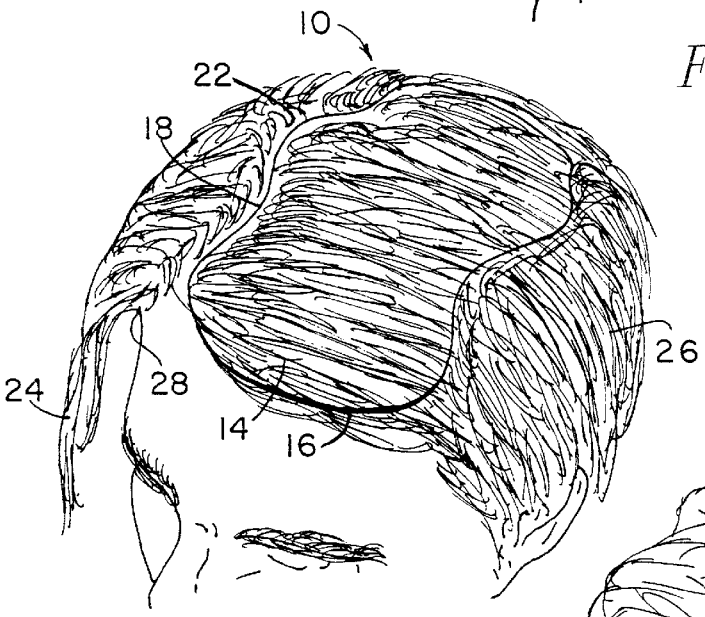
Fig. 3.
Fig. 4.
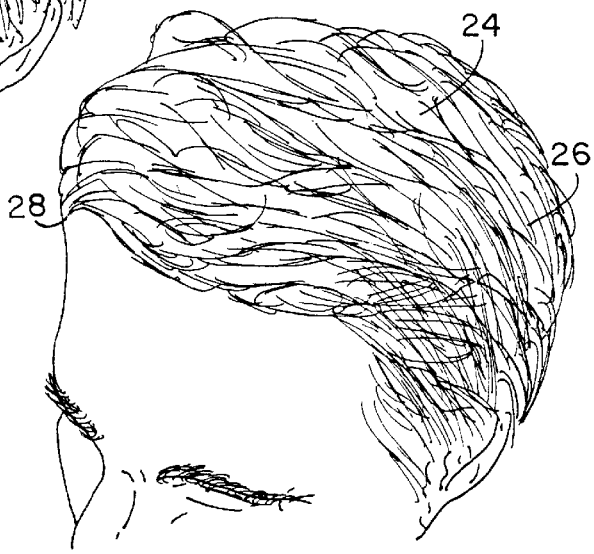

SCALP HAIR FOUNDATION TO PROVIDE ADDITIONAL HAIR

FEDERALLY SPONSORED RESEARCH OR DEVELOPMENT

Not applicable.

RELATED APPLICATIONS

Not applicable.

MICROFICHE APPENDIX

Not applicable.

BACKGROUND OF THE INVENTION

1. Field of the Invention

The present invention deals with the field of supplemental hair. More particularly, the invention is concerned with a method for covering a bald area on a person's head by attaching a filler piece having a foundation with filler hair attached thereto and conforming substantially to the shape of the bald area, wherein side hair is positioned over the piece and commingled with the filler hair.

2. Description of the Prior Art

Persons with a bald area, such as those with male pattern baldness, sometimes comb side hair over the bald area. With this technique, the bald area is still apparent and there is a tendency for the side hair to fall from the bald area when the person's head is tilted. A conventional hairpiece may not be economical, or may not be appropriate if the bald area is relatively small.

SUMMARY OF THE INVENTION

The present invention solves the prior art problems mentioned above and provides a distinct advance in the state of the art. In particular, the method hereof provides an economical and effective way for covering a bald area on a person's head.

The preferred method for covering a bald area on a person's head uses a filler piece having a foundation with filler hair attached thereto and conforming substantially to the shape of the bald area. The filler piece is attached to the bald area by adhering the foundation thereto. Side hair of sufficient length is then positioned in spanning relationship with the filler piece. The side hair is commingled with the filler hair to hold the side hair in position and visually integrated to conceal the presence of the filler piece. In preferred forms, the side hair is also positioned in concealing relationship with the forward edge of the filler piece and commingled with other hair on the opposed side of the bald area.

BRIEF DESCRIPTION OF THE DRAWINGS

FIG. 1 is a pictorial view of the preferred filler piece in accordance with the present invention;

FIG. 2 is a top, left, front view of a person's head presenting a bald area to be covered in accordance with the present invention;

FIG. 3 is a view similar to FIG. 2 but showing the filler piece of FIG. 1 in position on the bald area of FIG. 2; and FIG. 4 is a view similar to FIG. 3 but showing the side hair in spanning and concealing relationship with the filler piece.

DETAILED DESCRIPTION OF THE PREFERRED EMBODIMENT

FIG. 1 illustrates preferred filler piece 10 in accordance with the present invention. Filler piece 10 includes foundation 12 and supplemental or filler hair 14 attached thereto. Filler piece 10 presents forward edge 16 as part of foundation periphery 18. Foundation 12 and filler hair 14 are conventional as commonly used for hairpieces.

FIG. 2 is a view of a person's head illustrating bald area 20 presenting boundary 22. FIG. 2 also illustrates side hair 24 adjacent one side of bald area 20 and is sufficiently long to span bald area 20, and further shows other hair 26 adjacent the opposed side of bald area 20. Side hair 24 presents front hairline 28.

Filler piece 10 is configured to the shape of bald area 20, and foundation periphery 18 conforms substantially to bald area boundary 22. Additionally, filler piece 10 is configured so that forward edge 16 is recessed from front hairline 28. In the preferred embodiment, filler hair 14 and side hair 24 present the same color and texture, and filler hair 14 is shorter than side hair 24.

In the preferred method of the present invention, filler piece 10 is made with the structure as described above. Bald area 20 is cleared of any side hair and filler piece 10 positioned thereon as shown in FIG. 3 so that foundation periphery 18 abuts bald area boundary 22. In the preferred embodiment, foundation 12 is adhered to bald area 20 using conventional hairpiece adhesive.

Referring to FIG. 4, side hair 24 is then positioned by combing or the like over filler piece 10 and thereby over bald area 20. More particularly, side hair 24 is placed in a spanning relationship with filler piece 10 so that the ends of side hair 24 are positioned onto the other hair 26 on the other side of bald area 20.

Also, side hair 24 is positioned in concealing relationship with forward edge 16. This is aided by forward edge 16 being recessed behind front hairline 28.

Side hair 24 is then commingled with filler hair 14 such as by combing and other techniques well known to those skilled in the art in order to hold side hair 24 in the spanning relationship with filler piece 10 as shown in FIG. 4. In addition, side hair 24 is commingled with other hair 26 so that the ends of side hair 24 are also held in place. It is preferred that side hair 24 and filler hair 14 be visually integrated to conceal the presence of filler piece 10.

In view of the discussion above, it will now be appreciated that the present invention provides a simple and economical way to cover a bald area having adjacent side hair. As illustrated in FIG. 4, the bald area is concealed as is the presence of the filler piece itself. Moreover, the filler piece can be placed in a rapid and efficient manner.

Those skilled in the art will appreciate that the present invention encompasses many variations in the preferred embodiment described herein. Having described this embodiment, the following is claimed as new and desired to be secured by Letters Patent:

What is claimed is:

1. A method of covering a bald area on a person's head, the bald area presenting a boundary, the person having side hair adjacent one side of the bald area of sufficient length to span the bald area and having other hair adjacent the opposed side of the bald area, said method comprising the steps of:

(a) making a filler piece configured to the shape of the bald area and including a foundation with filler hair attached thereto and with said foundation presenting a periphery conforming substantially to the boundary of the bald area;

(b) displacing any side hair from the bald area;

(c) attaching said filler piece to the bald area by adhering said foundation thereto with said periphery abutting the bald area boundary;

(d) positioning the side hair in spanning relationship with said filler piece; and (e) holding the side hair in said spanning relationship by commingling the side hair with the filler hair, and concealing the presence of said filler piece by visually integrating the side hair and said filler hair in order to cover the bald area.

2. The method as set forth in claim 1, said filler piece presenting a forward edge adjacent the forehead of the person, step (d) including the step of positioning a portion of the side hair in concealing relationship with said forward edge.

3. The method as set forth in claim 1, step (d) including the step of positioning the side hair onto the other hair, step (e) including the step of commingling the side hair with the other hair.

4. The method as set forth in claim 1, said filler hair presenting a length substantially less than that of the side hair.

5. The method as set forth in claim 1, the person's side hair presenting a front hair line, said filler piece presenting a forward edge, step (a) including the step of configuring said filler piece so that said forward edge is recessed from the front hair line.

6. The method as set forth in claim 5, step (d) including the step of positioning a portion of the side hair in concealing relationship with said forward edge.

7. A method of covering a bald area on a person's head, the bald area presenting a boundary, the person having side hair adjacent one side of the bald area of sufficient length to span the bald area and having other hair adjacent the opposed side of the bald area, said method comprising the steps of:

(a) making a filler piece configured to the shape of the bald area and including a foundation with filler hair attached thereto and with the foundation presenting a periphery conforming substantially to the boundary of the bald area, said filler hair presenting a length substantially less than that of the side hair, the person's side hair presenting a front hair line, the periphery of said filler piece presenting a forward edge, step (a) including the step of configuring said filler piece so that said forward edge is recessed from the front hair line;

(b) displacing any side hair from the bald area;

(c) attaching said filler piece to the bald area by adhering said foundation thereto;

(d) positioning the side hair in spanning relationship with said filler piece and onto the other hair, and further positioning a portion of the side hair in concealing relationship with said forward edge; and (e) holding the side hair in position in said spanning relationship by commingling the side hair with said filler hair and commingling the side hair with the other hair, and concealing the presence of said filler piece by visually integrating the side hair and said filler hair in order to cover the bald area.

* * * * *